US005131173A

United States Patent [19]

Anderié

[11] Patent Number: 5,131,173

[45] Date of Patent: Jul. 21, 1992

[54] OUTSOLE FOR SPORTS SHOES

[75] Inventor: Wolf Anderié, Herzogenaurach, Fed. Rep. of Germany

[73] Assignee: Adidas AG, Herzogenaurach, Fed. Rep. of Germany

[21] Appl. No.: 423,451

[22] PCT Filed: Mar. 17, 1988

[86] PCT No.: PCT/DE88/00162

§ 371 Date: Sep. 27, 1989

§ 102(e) Date: Sep. 27, 1989

[87] PCT Pub. No.: WO88/08677

PCT Pub. Date: Nov. 17, 1988

[30] Foreign Application Priority Data

May 15, 1987 [DE] Fed. Rep. of Germany ..... 3716424
Mar. 17, 1988 [EP] European Pat. Off. ..... 88902.401.4

[51] Int. Cl.[5] ..... A43B 13/00; A43B 13/18; A43B 13/12; A43B 5/00

[52] U.S. Cl. ..... 36/25 R; 36/28; 36/30 R; 36/31; 36/114; 36/32 R

[58] Field of Search ..... 36/28, 30 R, 3 T, 32 R, 36/102, 114

[56] References Cited

U.S. PATENT DOCUMENTS

| | | | |
|---|---|---|---|
| 3,597,199 | 7/1986 | Hong | 36/114 |
| 4,030,213 | 6/1977 | Daswick | 36/30 R |
| 4,366,634 | 1/1983 | Giese et al. | 36/32 R |
| 4,389,798 | 6/1983 | Tilles | 36/32 R |
| 4,866,860 | 12/1989 | Blissett et al. | 36/28 |

*Primary Examiner*—Paul T. Sewell
*Assistant Examiner*—Marie D. Patterson

[57] ABSTRACT

An outsole for sports shoes comprising a carrier element (1) of relatively hard material and relatively soft sole portions (2, 3) which are secured to the carrier element on the outward side thereof. The carrier element (1) comprises a sole plate (11) which is stiffened by stiffening wells which are disposed approximately perpendicular to the surface of the plate and which substantially follow the contour of the edge of the sole. To provide for deformability of the carrier element (1), in the shank region (4) the height of the stiffening walls (13, 14) is at least locally markedly lower than in the heel region of the sole plate (FIG. 1).

8 Claims, 3 Drawing Sheets

Figure 1:
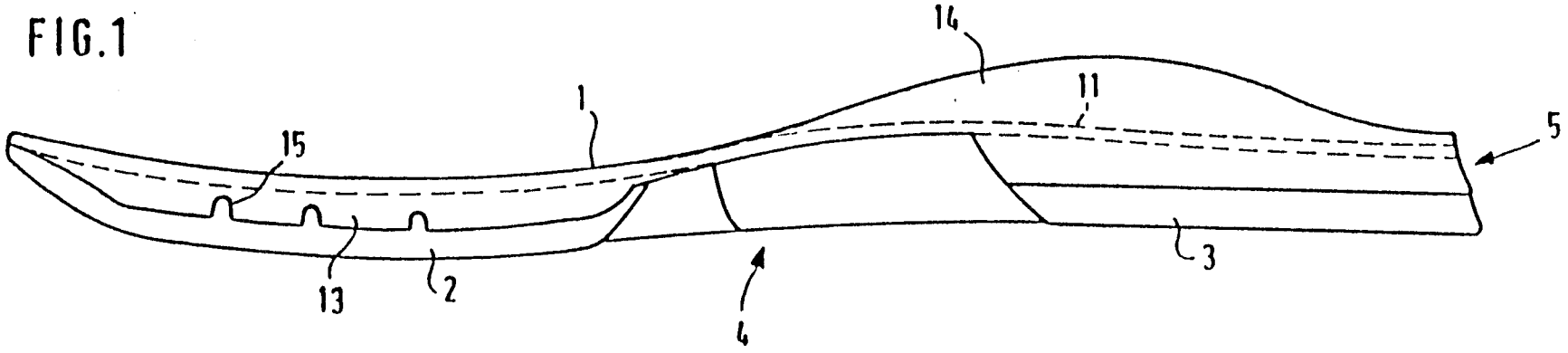

FIG. 4
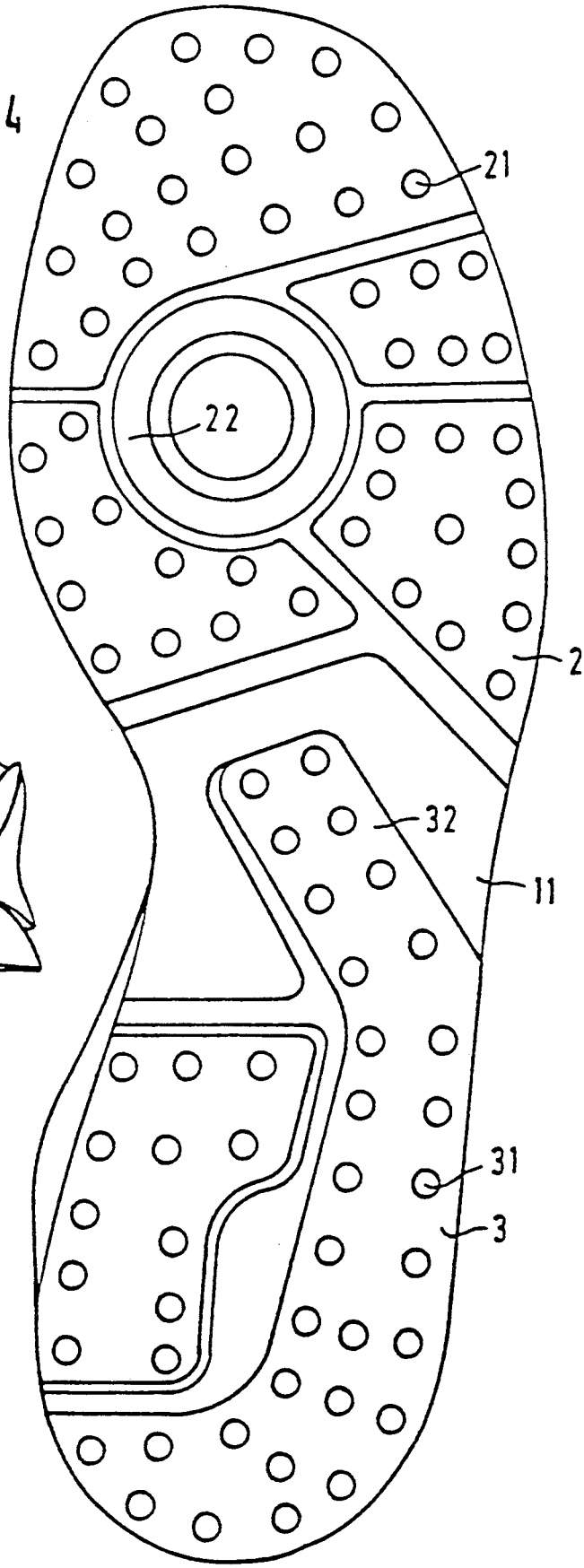
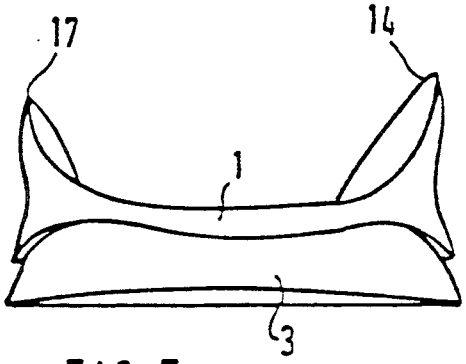
FIG. 5

OUTSOLE FOR SPORTS SHOES

The invention relates to an outsole for sports shoes comprising a carrier element of relatively hard material and relatively softer sole portions secured to the carrier element on the outward side thereof.

In a known sports shoe sole of the kind set forth above (U.S. Pat. No. 4,030,213), the sole portions which comprise very yielding rubber or corresponding elastomeric material are secured to a carrier element which in turn consists of a comparatively hard material, for example hard rubber or light metal or alloy, and consequently is generally stiff. The carrier element is of an arcuately curved configuration in the longitudinal direction of the sole on the underside thereof and in the shank region is of such a thickness that it comes into contact with the ground and is thus operative as a support, between the parts of the sole which are fixed on the front sole portion and in the heel region. The intention behind that outsole construction is that, when running and in particular with the rolling movement of the foot, the foot is supported firmly and relatively uniformly in respect of position by means of the carrier element, while however, due to the softly yielding sole portions, the sole provides a substantial impact damping effect and a certain catapult effect.

Although, by virtue of the arrangement of the softly yielding sole portions under the non-deformable stiff carrier element, that known sole construction provides a good impact damping action, it does however suffer from the disadvantage that the stiff carrier element completely prevents the natural rolling motion and movements of the foot and the support and guide function which it is intended to perform is very substantially adversely affected by the yielding sole portions.

The object of the present invention is to provide an outsole of that kind, in which the support and guide function is not adversely affected by the yielding sole portions.

In accordance with the invention, that object is attained in that the carrier element is a sole plate with stiffening walls which are disposed approximately perpendicularly to the surface of the sole plate and which substantially follow the contour of the edge of the sole, and that to provide for deformability of the carrier element in the shank region the height of the stiffening walls in the shank region of the sole plate is at least locally markedly lower than in the heel region of the sole plate.

The invention is based on the consideration that the support and guide function which the outsole is to perform in relation to the foot may not be transferred to the carrier element which is of a stiff shape, to such an extent that the foot can no longer perform its natural movement. As biomechanical investigations have shown, the support and guide function requires control by the foot itself; that cannot be achieved by a carrier element alone and is consequently eliminated by virtue of a stiff non-deformable carrier element. For that reason the carrier element in the outsole according to the invention is in the form of a sole plate which in itself has a certain degree of stiffness of shape but which is fixed by a 'frame' of lateral stiffening walls in the manner of a double-T-beam. Without the thickness of the sole plate itself having to be altered, that fixing effect and therewith the longitudinal stiffness can be very specifically adjusted, by means of the height of the lateral stiffening walls. In that connection, a reduced height of the stiffening walls in the shank region ensures that in that area the sole plate can perform both a bending movement about a transverse axis and also a torsional movement about a longitudinal axis in order to be able to follow the corresponding movements of the foot in the rolling motion thereof, to the necessary degree. Therefore, in combination with the above-mentioned control action by the runner himself, the carrier element can perform the desired support and guide function without adversely affecting the runner in his running movement and fatigueing him, by virtue of an unnatural foot attitude and movement. The further essential function of providing a damping effect upon impact and throughout the entire rolling movement is performed exclusively by the softly yielding sole portions which are secured to the underside of the carrier element.

An important advantage which is achieved with the above-discussed design is that, as a result of the carrier element being in the form of a (thin) sole plate with lateral stiffening walls, the weight of the carrier element can be considerably reduced in comparison with the known construction described in the opening part of this specification, as the carrier element enjoys its stiffness in respect of shape by virtue of its configuration in the manner of a double-T-member or box section. To produce the desired stability in respect of shape of the carrier element, it comprises plastic materials which are set at a hard level, for example polyamide or polyurethane, which are possibly reinforced with carbon fibres or glass fibres. By virtue of their hardness those materials have a low level of deformability in respect of compression and tension but they have the necessary degree of flexural elasticity so that the carrier element can experience bending and torsional deformation at least to the above-indicated degree.

For stiffness reasons it is in principle immaterial whether the stiffening walls project only upwardly or downwardly beyond the sole plate so that both are possible in accordance with the invention. However it is of particular advantage for the stiffening walls to be caused to project upwardly and downwardly beyond the sole plate because that arrangement provides lateral boundary edges or frames for the sole elements which are mounted on the outward side of the sole; the boundary edges or frames prevent lateral deflection of the yielding sole portions when put under load, and a 'floating' effect caused thereby. In that connection it is possible to envisage that the sole portions are not connected to the lateral walls surrounding them, in a fixed manner, for example by adhesive or by being cast directly thereon, in order to promote compression deformation into the interior of the frames formed by the side walls. On the other hand the part of the side walls which projects upwardly beyond the sole plate and which can be connected to the upper portion of the shoe forms an enclosure for the foot itself and thereby promotes the above-described support and guide function of the carrier element. The sole portions which are to be secured to the carrier element may be either fixedly or releasably arranged thereon. As the support and guide function of the sole is performed exclusively by the carrier element, the sole portions may be designed solely from the points of view of optimum damping and may also be arranged only in the regions of the outsole in which the damping function requires that and significant contact with the ground is to be expected. Thus the sole portions which are arranged on the front sole part and in the heel region are advantageously separated from each other so that they are at a spacing from each other in the shank region. In that way the deformation characteristics of the carrier element are not influenced by the sole portions which are normally of a plate-like form. If however such an influence is desirable to a certain degree, then one of the two sole portions which are disposed on the front sole part or in the heel region may be provided with a narrow projection which extends in the longitudinal direction of the sole and which projects into the shank region and which is connected to the underside of the sole plate. By virtue of being joined in one piece with the associated sole portion, that arrangement can provide for an increase in the bending strength of the carrier element in the shank region, in dependence on the bending strength of the projection itself. On the other hand however it is also possible for a separate sole portion to be arranged in the shank region, that sole portion not being connected to the sole portions which are disposed in front of and rearwardly of same, and serving essentially only as a support means. In that case the bending characteristics of the carrier element remain substantially unaffected.

Other advantageous embodiments are set forth in the further subsidiary claims.

Figure 2:
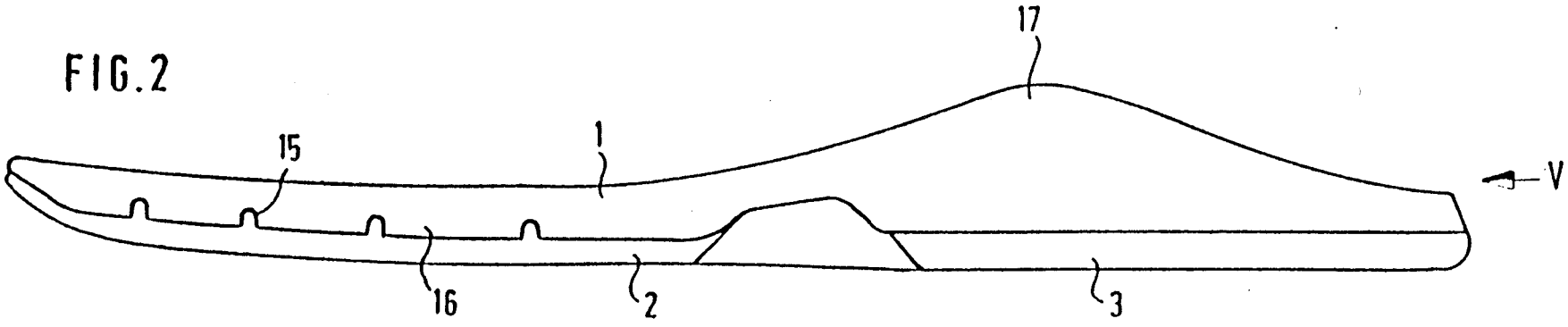
Figure 3:
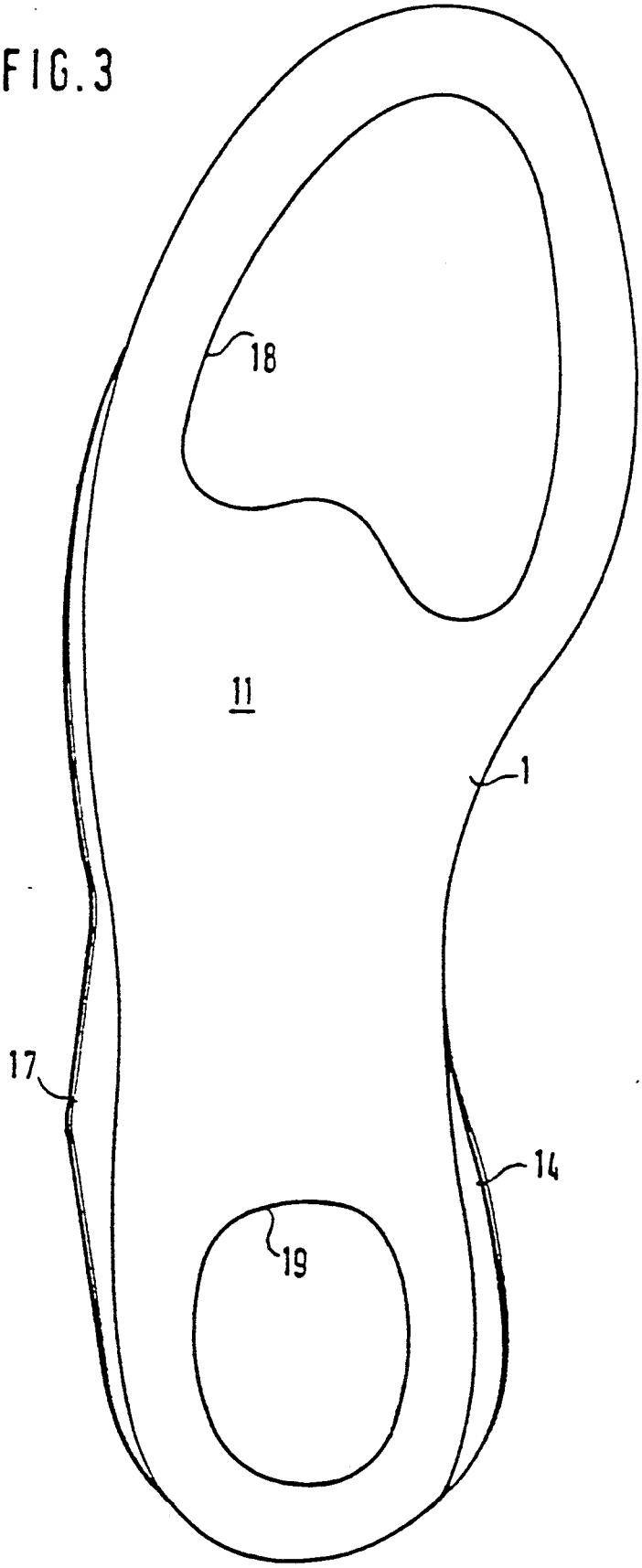

An embodiment of the invention is described in greater detail hereinafter with reference to the accompanying drawings in which:

FIG. 1 is a side view of an outsole according to the invention, from the inward side of the foot, FIG. 2 is a side view from the outward side of the foot, FIG. 3 is a plan view of the outsole shown in FIGS. 1 and 2, FIG. 4 is a view of the outsole from below, and FIG. 5 is a rear view of the outsole, viewing in the direction indicated by the arrow V in FIG. 2.

The outsole according to the invention as illustrated in the drawings substantially comprises a carrier element which is generally identified by reference numeral 1, and two sole portions 2 and 3 which are secured to the underside of the carrier element and which are secured in the front sole portion and in the heel region respectively of the carrier element. The carrier element in turn comprises a continuous sole plate 11 which is shown in broken lines in FIG. 1 and which is only about 1.5 to 3 mm in thickness, and lateral stiffening walls 13, 14 and 16, 17. The stiffening walls 13, 14 are formed in one piece with the sole plate 11 at the inward edge of the sole plate 11 and extend along the edge contour thereof, wherein the stiffening wall 13 is limited to the front sole region and projects only downwardly beyond the sole plate 11, while the stiffening wall 14 begins at the end of the front sole region, gradually increases in height in the shank region 4, reaches its maximum at the end of the shank region 4 and in the transition to the heel region, and then falls away again to a very low height towards the heel apex line 5. While the stiffening wall 14 only extends upwardly beyond the sole plate 11 at the end of the front sole region and in the shank region 4, it extends both upwardly and downwardly in the heel region.

The outward edge of the carrier element 1, as shown in FIG. 2, is of a similar configuration. In that case the stiffening wall 16 which is limited to the front sole region only extends downwardly beyond the sole plate 11 while in the shank region 4 and in the heel region the stiffening wall 17 provided at those locations projects both upwardly and downwardly.

The carrier element 1 comprises a polyamide or polyurethane which is set to a hard level and which is possibly reinforced by carbon or glass fibres.

As can be seen from FIG. 3, the sole plate 11 has an aperture 18 in the front sole region and an aperture 19 in the heel region; the top side of the sole portions 2 and 3 respectively are exposed in the apertures 18 and 19 and the edges thereof are bevelled to avoid pressure points. In addition the stiffening walls 13 and 16 in the front sole region may have grooves 15 which start from the lower edge of the stiffening walls and which serve to reduce the stiffness in respect of bending about a transverse axis of the front sole region of the carrier element 1 without having to reduce the height of the stiffening walls 13 and 16 which enclose the sole portion 2.

The sole portions 2 and 3 comprise any sole material which has damping properties, for example foamed polyurethane, with a Shore hardness in the range of from 30 to 70. They are essentially of a plate-like form and of the contour shown in FIG. 4. In addition they have profiling 21 and 31 respectively, which is only indicated in FIG. 4 and which in the illustrated embodiment is formed by small cup-like recesses. In addition, provided at the centre of the ball part of the sole portion 2 is a 'turning circle' 22 in the form of an annular profile. The rear sole portion 3 has a part 32 which projects forwardly inclinedly with respect to the longitudinal direction of the shoe and which is fixedly joined to the underside of the sole plate 11 and which terminates just before the rearward edge of the sole portion 2. The projecting portion 32 is considerably narrower than the carrier element 11 in the shank region 4 and therefore makes only a slight contribution to increasing the bending stiffness of the carrier element 1 in the shank region 4, while however having almost no influence on the torsional stiffness. The sole portions 2 and 3 are fixedly connected, for example by adhesive, to the underside of the sole plate 11.

Differing from the apertures 18 and 19 shown in FIG. 3, the sole plate may have apertures of a different configuration and may also have a respective plurality of apertures which ensure that in those regions the sole plate permits a certain degree of deformation in order to support the foot better on the yielding and damping sole portions 2 and 3 which are disposed therebeneath. It is also possible to envisage the sole plate 11 further being provided in the shank region 4 with longitudinally or inclinedly extending recesses or apertures in order thereby to control the torsional and bending capability of the carrier element 1.

The outsole in accordance with the invention may be connected in the usual manner to an upper portion (not shown) of a shoe, for example by adhesive, wherein the lateral stiffening walls are also connected to the parts of the upper portion of the shoe, which are covered by the walls. The above-described construction provides that the outsole is light and gives a good support and guide function in conjunction with a damping effect which can be selected as desired and which can be adjusted by suitable selection of material and thickness of the sole portions, independently of the carrier element.

I claim:

1. An outsole for shoes having a front sole region, a shank region and a heel region, comprising a sole plate of an elastically flexible hard plastics material, the sole plate having an upper surface and a lower surface and an edge defining the contour of the outsole, stiffening wall means on said edge projecting approximately perpendicularly with respect to at least one of said upper and lower surfaces and having at least one portion of minimum height, said portion of minimum height being in said shank region, and sole portions of a yielding plastics material softer than said sole plate material, said sole portions being connected to said lower surface of the sole plate within that portion of said stiffening wall means projecting downwardly with respect to said lower surface, said sole portions further projecting downwardly over said wall means, whereby said sole plate forms a carrier element for said sole portions and said portion of minimum height provides pronounced flexibility of said shank region in regard to torsion and bending.

2. An outsole according to claim 1 characterised in that the stiffening wall means (14, 17) project upwardly and downwardly beyond the sole plate (11).

3. An outsole according to claim 1 or claim 2 characterised in that the height of the stiffening wall means (14, 17) decreases in the heel region towards the apex line (5).

4. An outsole according to claim 1 characterised in that in the front sole region the stiffening wall means (13, 16) have grooves (15) to control the local deformability of the carrier element (1).

5. An outsole according to claim 1 characterised in that the sole plate (11) is provided at least in the heel region with one or more apertures (19) in which the sole portion (3) disposed therebeneath is exposed.

6. An outsole according to claim 1 characterised in that the sole portions (2 and 3) arranged in the front sole region and the heel region respectively of the carrier element (1) are separated from each other and keep the shank region (4) of the carrier element substantially free.

7. An outsole according to claim 6 characterised in that a separate sole portion is arranged in the shank region (4).

8. An outsole according to claim 1 characterised in that provided in the shank region is a projection (32), which extends in the longitudinal direction of the sole and which is connected to the underside of the sole plate (11), of one of the sole portions (2, 3) which are arranged in the front sole region and in the heel region respectively, said projection being substantially narrower than the carrier element (1).

* * * * *

UNITED STATES PATENT AND TRADEMARK OFFICE

CERTIFICATE OF CORRECTION

PATENT NO. : 5,131,173

DATED : July 21, 1992

INVENTOR(S) : Wolf Anderie

It is certified that error appears in the above-identified patent and that said Letters Patent is hereby corrected as shown below:

On the title page, Item [30] should read:

Foreign Application Priority Data

May 15, 1987 [DE] Fed. Rep. of Germany ..... 3716424

Signed and Sealed this

Twenty-first Day of September, 1993

Bruce Lehman

*Attest:*

BRUCE LEHMAN

*Attesting Officer*

*Commissioner of Patents and Trademarks*